US010159338B2

(12) United States Patent
Wobser

(10) Patent No.: US 10,159,338 B2
(45) Date of Patent: Dec. 25, 2018

(54) UNIVERSAL PIECE OF FURNITURE CONSISTING OF PANELS

(71) Applicant: Gunther Wobser, Lauda-Königshofen (DE)

(72) Inventor: Gunther Wobser, Lauda-Königshofen (DE)

( * ) Notice: Subject to any disclaimer, the term of this patent is extended or adjusted under 35 U.S.C. 154(b) by 0 days.

(21) Appl. No.: 15/109,075

(22) PCT Filed: Dec. 30, 2014

(86) PCT No.: PCT/EP2014/003476
§ 371 (c)(1),
(2) Date: Oct. 5, 2016

(87) PCT Pub. No.: WO2015/101412
PCT Pub. Date: Jul. 9, 2015

(65) Prior Publication Data

US 2017/0188703 A1 Jul. 6, 2017

(30) Foreign Application Priority Data

Dec. 30, 2013 (DE) ..... 20 2013 011 496 U

(51) Int. Cl.
*A47B 47/00* (2006.01)
*A47B 87/02* (2006.01)
(Continued)

(52) U.S. Cl.
CPC ..... *A47B 47/0075* (2013.01); *A47B 19/02* (2013.01); *A47B 47/042* (2013.01);
(Continued)

(58) Field of Classification Search
CPC ... A47B 47/042; A47B 47/0075; A47B 87/02; A47B 87/0292; A47B 87/0207
See application file for complete search history.

(56) References Cited

U.S. PATENT DOCUMENTS 1,894,061 A * 1/1933 Sanders ..... A63H 33/084 446/114
2,365,622 A * 12/1944 Bockius ..... A47B 47/05 211/186
(Continued)

FOREIGN PATENT DOCUMENTS

DE 96395 A1 3/1973
DE 3242148 A1 8/1984
(Continued)

OTHER PUBLICATIONS

German language Office Action dated Aug. 17, 2017 of corresponding European Patent Application No. 14838860.6 that cites the U.S. patent reference 2003/066813.

*Primary Examiner* — Kimberley S Wright
(74) *Attorney, Agent, or Firm* — Bachman & LaPointe, PC

(57) ABSTRACT

A multipurpose piece of furniture (1) has four square panels (3, 4, 6, 7), i.e., a first vertical side panel (3), a second vertical side panel (4) arranged parallel thereto, a third panel (6) that is arranged between an edge (5) of the first side panel (3) and an edge of the second side panel (4) at a right angle to the first side panel (3) and the second side panel (4) and that connects the first side panel (3) and the second side panel (4) into a U-shaped piece of furniture. The fourth panel is an intermediate panel (7) that is inserted into the piece of furniture between the first side panel (3) and the second side panel (4) at a right angle thereto and at a right angle to the third panel (6). At their four corners, the first side panel (3) and the second side panel (4) have recesses (33, 34) and/or projections (19, 20, 21, 22), wherein these are recessed in the corner regions of the side panels (3, 4) extending substantially in the shape of an elongated rectangle into the edges (5) of the side panels, or extending out of the edges in the
(Continued)

shape of an elongated rectangle and running at a right angle to each other in their directions of elongation at each of the corner regions.

11 Claims, 4 Drawing Sheets

(51) Int. Cl.

| | |
|---|---|
| ***F16B 12/00*** | (2006.01) |
| ***A47B 47/04*** | (2006.01) |
| ***A47B 19/02*** | (2006.01) |
| ***A47B 63/00*** | (2006.01) |
| ***A47B 85/04*** | (2006.01) |
| ***A47B 85/06*** | (2006.01) |
| ***A47C 9/00*** | (2006.01) |
| ***E04B 2/74*** | (2006.01) |

(52) U.S. Cl.
CPC ..... *A47B 63/00* (2013.01); *A47B 85/04* (2013.01); *A47B 85/06* (2013.01); *A47B 87/02* (2013.01); *A47B 87/0207* (2013.01); *A47C 9/007* (2013.01); *E04B 2/7405* (2013.01); *A47B 2230/16* (2013.01); *E04B 2002/7483* (2013.01)

(56) References Cited

U.S. PATENT DOCUMENTS 2,582,553 A * 1/1952 McMurtrie ..... A63H 33/108 211/189
2,645,545 A * 7/1953 Rozaffy ..... A47B 47/042 211/188
3,368,856 A * 2/1968 Tisdall ..... A47B 87/02 108/91
3,644,008 A * 2/1972 Overby ..... A47B 87/0253 312/107
3,661,434 A * 5/1972 Alster ..... A47B 47/005 312/108
3,786,400 A * 1/1974 Ege ..... H01R 13/633 439/372
3,861,327 A * 1/1975 Silson ..... A47B 47/042 108/190
3,924,376 A * 12/1975 Tsurumi ..... A63H 33/084 273/146
4,055,924 A * 11/1977 Beaver, Jr. ..... A47B 47/042 297/440.13
4,155,452 A * 5/1979 Wettermann ..... A61C 19/02 206/512
4,173,287 A * 11/1979 Kumakawa ..... B65D 9/12 206/600
4,232,916 A * 11/1980 Correia ..... A47B 47/042 108/53.3
4,455,102 A * 6/1984 Baroi ..... F16B 5/0614 403/173
4,582,002 A * 4/1986 Wright ..... A47B 47/042 108/60
4,886,326 A * 12/1989 Kuzyk ..... A47B 47/0041 108/180
5,335,606 A * 8/1994 Whitehead ..... A47B 87/0276 108/181
5,477,594 A * 12/1995 LePage ..... E04H 13/006 211/194
5,486,041 A * 1/1996 Sykes ..... A47B 87/007 312/108
5,603,415 A * 2/1997 Balnis, Jr. ..... A47B 81/068 211/40
6,675,979 B2 * 1/2004 Taylor ..... A47B 47/042 108/153.1
6,820,950 B1 * 11/2004 Sun ..... A47B 47/042 312/108
7,104,553 B2 * 9/2006 Gruber ..... B62B 3/006 206/505
7,431,296 B2 * 10/2008 Walsh ..... A63F 9/0413 273/146
7,472,969 B2 * 1/2009 Saravis ..... A47B 47/0033 312/108
7,918,515 B2 * 4/2011 Wang ..... A47B 47/005 211/194
9,211,020 B2 * 12/2015 Hodge ..... A47F 3/14
9,414,985 B2 * 8/2016 Ugartechea Berlanga ..... E04H 13/008
9,833,085 B2 * 12/2017 Adair ..... A47F 3/12
2002/0153682 A1 * 10/2002 Gruber ..... B62B 3/006 280/79.11
2003/0066813 A1 * 4/2003 Taylor ..... A47B 47/042 211/186
2005/0200250 A1 * 9/2005 Zillmann ..... F16B 12/2027 312/265.5
2007/0075043 A1 * 4/2007 Riogonzalez ..... B65D 11/1873 217/13
2008/0000863 A1 * 1/2008 DiBello ..... A47B 61/00 211/134
2010/0202852 A1 * 8/2010 Krause ..... F16B 12/2027 411/272
2011/0309072 A1 * 12/2011 Rio Gonzalez ..... B65D 5/001 220/4.28
2013/0026057 A1 * 1/2013 Shapiro ..... B65D 21/0212 206/459.5
2014/0017001 A1 * 1/2014 Maertens ..... A47B 47/042 403/376
2014/0030017 A1 * 1/2014 Luo ..... A47B 47/042 403/375
2014/0339969 A1 * 11/2014 Nielsen ..... A47B 87/0292 312/111
2015/0335151 A1 * 11/2015 Funfgeld ..... A47B 47/042 403/205
2017/0055700 A1 * 3/2017 Chung ..... A47B 47/0033
2017/0058926 A1 * 3/2017 Takubo ..... A63H 33/065
2017/0079426 A1 * 3/2017 Davis ..... B65D 21/0212

FOREIGN PATENT DOCUMENTS

| | | |
|---|---|---|
| DE | 92 00 474 U1 | 5/1992 |
| DE | 10 2008 005 067 A1 | 7/2009 |
| EP | 2149317 A1 | 2/2010 |
| WO | WO 99/39795 A1 | 8/1999 |

* cited by examiner

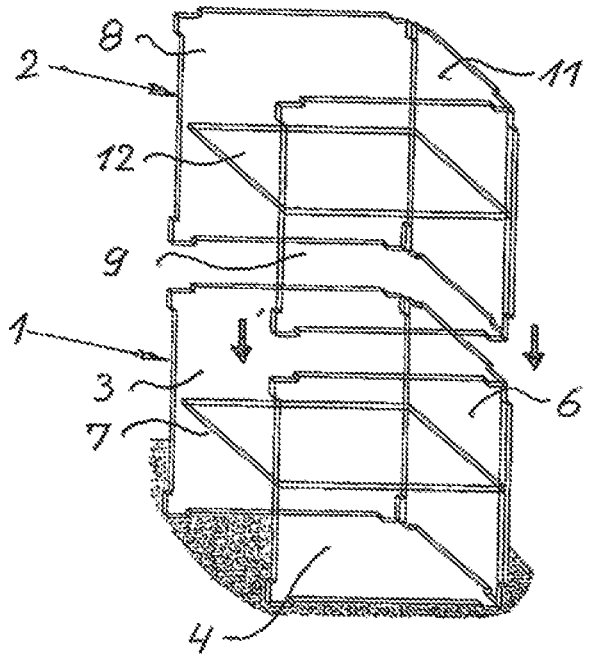
Fig. 6
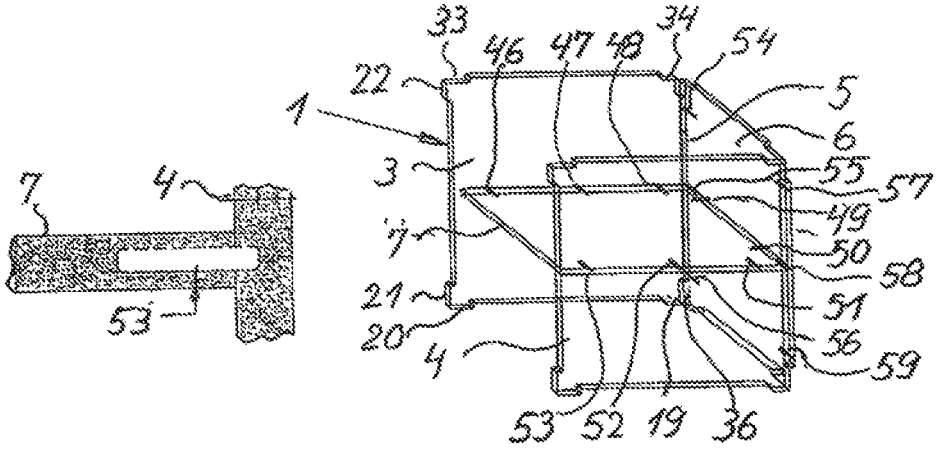
Fig. 7
Fig. 5

UNIVERSAL PIECE OF FURNITURE CONSISTING OF PANELS

CROSS REFERENCE TO RELATED APPLICATIONS

This application is a national stage of international application no. PCT/EP2014/003476 filed on Dec. 30, 2014 and claims the benefit of priority under 35 USC 119 of German Patent Application No. 20 2013 011 496.7 filed on Dec. 30, 2013, which is incorporated herein by reference.

The invention relates to a multipurpose piece of furniture that serves the purpose of not just one specific piece of furniture, but also at least one additional purpose of a normally different piece of furniture depending on the alignment of the piece of furniture relative to the floor at its setup site. Furthermore, at least two such pieces of furniture can be assembled in at least two different configurations relative to each other in order to be adapted to a specific purpose in each configuration. This takes into account different requirements on the piece of furniture, or assembled piece of furniture, in a space-saving and economical manner.

The prior art includes a multipurpose piece of household furniture which is suitable for a system solution for sectional and combination furniture founded on a basic element (DD 96395A1). The multipurpose piece of furniture consists of cube-shaped basic elements that each have three sidewalls of a cube arranged in a U-shape in which an inner surface is affixed at a right angle relative to the three sidewalls such that it spatially divides the interior of the cube at a ratio of ⅓ to ⅔. One element of this multipurpose piece of furniture can be used as a child seat at two different seat heights, as a stool for adults, and as a side table. Furthermore, a plurality of elements can be placed on each other or next to each at different positions such that mounting walls, room dividers and table/seat combinations can be created therefrom. The cube-shaped basic element does not have any special means for aligning and connecting at least two basic elements.

One known module for a furniture and shelf system consists of wall elements that each have the shape of a straight cylinder with a bottom surface, with a top surface and with six lateral surfaces. Four of the lateral surfaces are side surfaces that run in pairs at a 90° angle relative to each other, and at least two of the side surfaces have a recess which runs parallel to their border and extends up to a bottom surface of the straight cylinder. Furthermore, at least one of the side surfaces can have a projection which runs parallel to its border and which can be inserted into the recess of an adjacent wall element in order to connect two wall elements to each other and thereby construct a module. Due to their four side surfaces which run in pairs at a 90° angle relative to each other and have the recesses or projections, such wall elements are cumbersome, which can prevent an easy-to-handle, simple assembly of the module and restrict the economy of space.

The aforementioned object is achieved according to the invention with a basic shape of a universal piece of furniture consisting of panels by designing a piece of furniture with the features of claim 1.

Accordingly, the piece of furniture on which the invention is based comprises four substantially square panels of which one first vertical side panel and one second vertical side panel are arranged parallel at a distance from each other, one third panel that is arranged between an edge of the first side panel and an edge of the second side panel that is parallel thereto and is at a right angle to the first side panel and the second side panel, and that connects the first side panel and the second side panel into a U-shaped piece of furniture. In this piece of furniture, an intermediate panel is securely inserted between the first side panel and the second side panel at a right angle thereto and at a right angle to the third panel. A piece of furniture with great strength is thereby obtained with a relatively small mass or low weight.

The universal piece of furniture according to the invention is designed in a basic shape such that the first side panel and second side panel have recesses and/or projections at their four corner regions. The projections can serve as feet on the basic shape and the assembled shape of the piece of furniture. When assembling a piece of furniture consisting of at least two pieces of furniture with the basic shape, the recesses and projections make it easy to precisely align the individual pieces of furniture with the basic shape, wherein the recesses accommodate the similarly shaped projections and secure against unintentional, mainly horizontal shifting.

The recesses in the corner regions of the side panels are recessed into the edges of the side panels substantially in the shape of an elongated rectangle, and the projections in the corner regions extend out of the edges in the shape of an elongated rectangle. At each of the corner regions, the recesses and/or projections run at a right angle to each other substantially within the plane of the side panels.

Accordingly, the recesses and/or projections are at a maximum distance from each other such that when the piece of furniture is set up, it rests securely on its projections. Furthermore, this arrangement of the projections and recesses is elegant.

The production of the basic shape of the piece of furniture can be streamlined rationalized according to claim 2 in that the first side panel and second side panel have the same shape.

The intermediate panel is preferably arranged in the piece of furniture according to claim 3 such that it divides the interior, delimited by the two side panels and third panel, from the U-shaped piece of furniture into two halves of equal size. When the piece of furniture is set up with the intermediate panel in a horizontal position and the third panel in vertical position, the intermediate panel is situated in this case at about one-half the height of the first vertical side panel and second vertical side panel.

According to claim 4, two projections running at a right angle to each other extend the same distance out of two edges of the side panels. This allows the piece of furniture to be set up such that two projections at a distance from each other of a side panel project downward as feet of the piece of furniture, or are inserted in a side wall of a piece of furniture arranged under them.

Given the parallel arrangement of the two substantially square side panels at a distance from each other, and given their connection by means of the third panel between an edge of the first side panel and an edge of the second side panel parallel thereto into a U-shaped piece of furniture, a spatially cuboidal piece of furniture results in other words, wherein the three sides of the piece of furniture are only delimited by the edges of the panels and are open. The edges or borders of the panels are equal in length.

Preferably, the border length according to claim 6, or the length of the edge, is 50 cm. Given this dimension, the piece of furniture can serve as a chair in its single-piece basic shape when it is set up according to claim 8 with the intermediate panel in a horizontal position and the third panel in a vertical position.

Alternatively, a border length of 38 cm has proven to be favorable, particularly for a stool or table according to claim 7.

When the piece of furniture with an immediate panel is set up in vertical position and with the third panel in horizontal position, it forms a stable stool or can also be used as a side table.

According to claim 10, the two side panels can be securely connected with dowels to the intermediate panel and the adjacent third panel, and the intermediate panel can be connected to the adjacent third panel.

If at least two pieces of furniture with the basic shape are arranged superimposed into an assembled piece of furniture according to claim 11, the usefulness for different purposes can be further increased. According to claim 11, the two pieces of furniture are assembled superimposed such that the projections on the bottom edges of the top piece of furniture engage in each other or, conversely, projections on the top edges of the bottom piece of furniture engage in recesses in the bottom edges of the top piece furniture.

When the piece of furniture according to claim 11 is assembled from two pieces of furniture with the single-part basic shape that are oriented according to claim 9 such that the intermediate panel is in a vertical position and the third panel is in a horizontal position, the assembled piece of furniture is suitable for being a medium-depth bookshelf which is open on two sides, or a room divider. According to claim 3, the intermediate panel is preferably arranged at half the height of the first side panel and the second side panel of each of the two single-part basic shapes.

When, contrastingly, the two pieces of furniture with the single-part basic shape are assembled superimposed such that the intermediate panel is in a horizontal position and the third panel is in a vertical position according to claim 8, the assembled piece of furniture is suitable for being a low bookshelf with a rear wall, or a room divider, or a barstool, or a podium.

Embodiments of the invention will be explained below with reference to a drawing with seven figures which reveal advantageous features. In the figures:

FIG. 5 shows a schematic diagram in which the projections and recesses are discernible of a piece of furniture with the basic shape that is also suitable for being assembled into an assembled piece of furniture with another piece of furniture with the same basic shape according to FIGS. 1 to 4 and 6;

FIG. 6 shows a schematic diagram of two pieces of furniture with the basic shape according to FIG. 5 before completing the vertical assembly, from which the association of the projections and the recesses of the two pieces of furniture is discernible;

FIG. 7 shows the design and arrangement of a dowel in an intermediate panel and an adjacent side panel of the piece of furniture according to FIG. 5.

In the drawing, the same parts are provided with corresponding reference signs.

Figure 1:
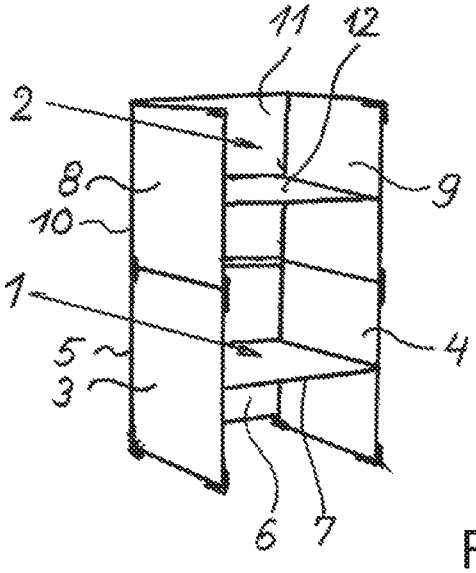
FIG. 1 shows a schematic diagram of a piece of furniture assembled from two superimposed pieces of furniture with a basic shape in which an intermediate panel is situated in a horizontal position between two side panels, and a third panel is situated at the edges of the side panels in a vertical position.

In FIG. 1, there is an assembled piece of furniture that is suitable for being a low bookshelf with a rear wall, or a barstool consisting of a bottom piece of furniture 1 with a basic shape on which is placed a top piece of furniture 2 with the same basic shape.

The bottom piece of furniture 1 and the top piece of furniture 2 each comprise a first vertical side panel 3 and, at a parallel distance thereto, a second vertical side panel 4. A third panel 6 is securely arranged between an edge 5 of the first side panel and an edge of the second side panel 4, which is not shown in FIG. 1, when the piece of furniture 1 is in a position in which the third panel is also vertically aligned. Consequently, the piece of furniture with the basic shape is approximately U-shaped in a bird's eye view.

The piece of furniture with the basic shape is completed with an intermediate panel 7 which is inserted in FIG. 1 in a horizontal position between the first side panel and the second side panel at a right angle thereto, and at a right angle to the third panel 6, for example in grooves which are not shown in FIG. 1.

The top piece of furniture 2 with the basic shape is designed like the bottom piece of furniture 1 and has the first vertical side panel 8 and, at a vertical distance thereto, the second vertical side panel 9. On its parallel, vertical edges such as 10, the first side panel 8 is securely connected by a third panel 11 to the second side panel 9. They form the piece of furniture 2 that is approximately U-shaped in a bird's eye view which, spatially, can be considered a cube, with edges or borders of equal length, and that is open on three sides.

Figure 3:
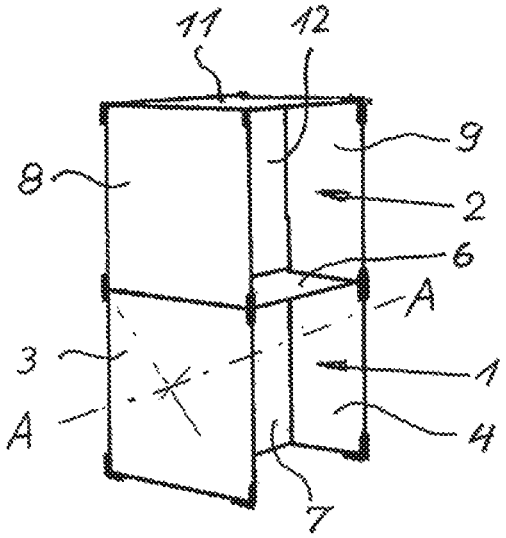
FIG. 3 shows a schematic diagram of an almost assembled piece of furniture consisting of two pieces of furniture with the basic shape, wherein the pieces of furniture with the basic shape are arranged with the intermediate panel in a vertical position and the third panel in a horizontal position.

In FIG. 3, the bottom piece of furniture 1 and top piece of furniture 2 are set up or assembled rotated 90° about an imaginary horizontal axis A-A which runs perpendicular, i.e., at a right angle, through the first vertical side panel 3 and the second vertical side panel 4 as well as through the intermediate panel 7. The imaginary axis to the top piece of furniture 2 is not shown.

As a result of this rotated position of the bottom piece of furniture 1 and the top piece of furniture 2, the third panel 6 of the bottom piece of furniture 1, or the third panel 11 of the top piece of furniture 1, is arranged horizontally, and the bottom intermediate panel 7, or the top intermediate panel 12, is arranged vertically.

In the setup of the basic shape of the piece of furniture shown in FIG. 3, said piece of furniture is for example suitable for being a medium-depth bookshelf open on both sides, or a room divider, or a bar table, or a podium.

Figure 2:
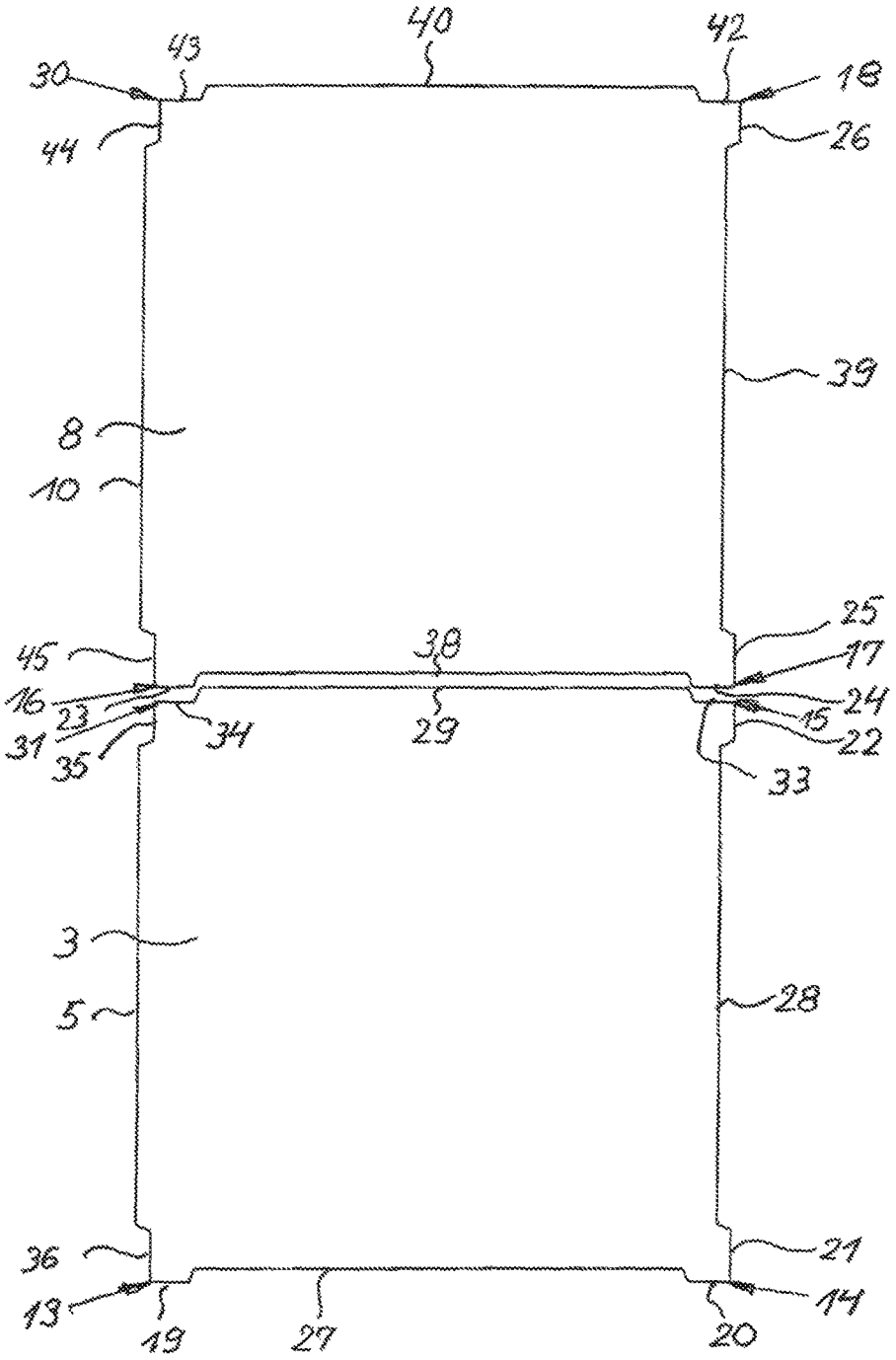
FIG. 2 shows a side view of the first vertical side panel of the bottom piece of furniture with the basic shape, and the first vertical side panel of the top piece of furniture with the basic shape, nearly assembled according to FIG. 1.

In FIG. 2, the first vertical side panel 3 of the bottom piece of furniture 1 from FIG. 1, and the first vertical panel 8 of the top piece of furniture 2 from FIG. 1, are depicted enlarged and somewhat vertically exploded before the assembled state. Situated parallel to the first bottom vertical side panel 3 and the first vertical top side panel 4, and at a distance from them, is a second side panel 4 and 9 shaped like the first vertical side panel. The second vertical side panels are therefore behind the plane of the drawing in FIG. 2.

The side panels, in particular the first bottom side panel 3 and first top side panel 8 visible in FIG. 2, are square and can preferably have an a border length of 50 cm.

Instead, a border length of 38 cm has proven to be particularly favorable per se, at least in some applications of the basic shape of the piece of furniture, and for pieces of furniture assembled therefrom.

The first bottom side panel 3 and the first top side panel 8 each have corresponding projections 19-22 and 23-26 in three corner regions 13, 14, 15 and 16, 17, 18 that are formed on edges 27, 28 of the first bottom side panel 3, and edges 29, 30 of the first top side panel 8. The middle projections 20, 21 and 24, 25 formed between the projections 19, 22 of the first bottom side panel 3 and 23, 26 of the first top side panel 8 can be formed as a uniform projection as shown in FIG. 2. The projections such as 19, 20, each extend in the direction of the edge such as 27 from which they project.

Accordingly, each of the two edges that run at a right angle to each other, such as 27, 28 of the side panel 3, is enclosed between two projections 19, 20 and 21, 22.

The two other edges 5, 29, in this case of the first bottom side panel 3, that about each other at a right angle, are each bordered by two recesses 33, 34 and 35, 36.

Analogously, the edges 40, 41 of the first top side panel 8 are enclosed by recesses 42, 43 and 44, 45.

The bottom piece of furniture 1 with the basic shape is depicted diagrammatically in FIG. 5 in a position rotated about the vertical axis in comparison to FIG. 1 with discernible projections and recesses which are designated as in FIG. 2.

In addition, FIG. 5 reveals the arrangement of dowels 46-59 that securely connect the two side panels 3, 4 to the intermediate panel 7 and the adjacent third panel 6, as well as the intermediate panel 7 to the adjacent third panel 6. They run horizontally in this position of the basic shape of the piece of furniture. A detail of the horizontal dowel arrangement between the third panel 6 and the intermediate panel 7 is depicted in FIG. 7. The dowel is in particular a wood dowel with a typical diameter of 5 mm and a length of 30 mm. It extends into the intermediate panel 7 designed as a multilayer panel which is approximately 12 mm thick. The dowel arrangement holds the side panels, third panel and intermediate panels securely together and can be disconnected if needed. The top piece of furniture 2 in FIG. 6 is designed in the same manner.

As can be deduced from FIG. 2, two pieces of furniture with the basic shape to which belong the first bottom vertical side panel 3 and the first top vertical side panel 8 are assembled such that the projections 23, 24 on the bottom edge 38 of the first top vertical side panel 8 engage in the recesses 33, 34 of the first bottom vertical side panel 8, or come in contact with the recesses, such that they cannot be shifted horizontally.

As can be seen in FIG. 2, one side of the projections 23, 24 of the first top vertical side panel and the recesses 33, 34 does not run strictly at a right angle to the direction of extension of the projection or recess, but rather obliquely to facilitate the insertion of the first top vertical side panel 8 into the first bottom vertical side panel 3, even though a precise alignment of the two vertical side panels is achieved. The projections 19-26 and recesses 33-36 and 42-45 are accordingly only basically or approximately rectangular, i.e., trapezoidal.

The above explanations of the first vertical side panels in FIG. 2 apply analogously to the second vertical side panels 4, 9 in FIG. 1.

As can be seen in FIG. 2, of the projections and recesses of the vertical side panels of the configuration depicted in FIG. 2, only the projections 23, 24 and recesses 33, 34 of the vertical side panels have a fitting function for assembling the side panels, or the pieces of furniture provided therewith in the basic shape. The projections such as 19, 11, 20 at the bottom edge such as 27 of the side panels of the bottom piece of furniture with the basic shape contrastingly serve as feet for the assembled piece of furniture.

FIG. 6 depicts the assembly of the bottom piece of furniture 1 with the top piece of furniture 2 in a diagram. This also illustrates how the projections and recesses of the two pieces of furniture engage in each other to precisely align said pieces of furniture in the assembled piece of furniture.

Figure 4:
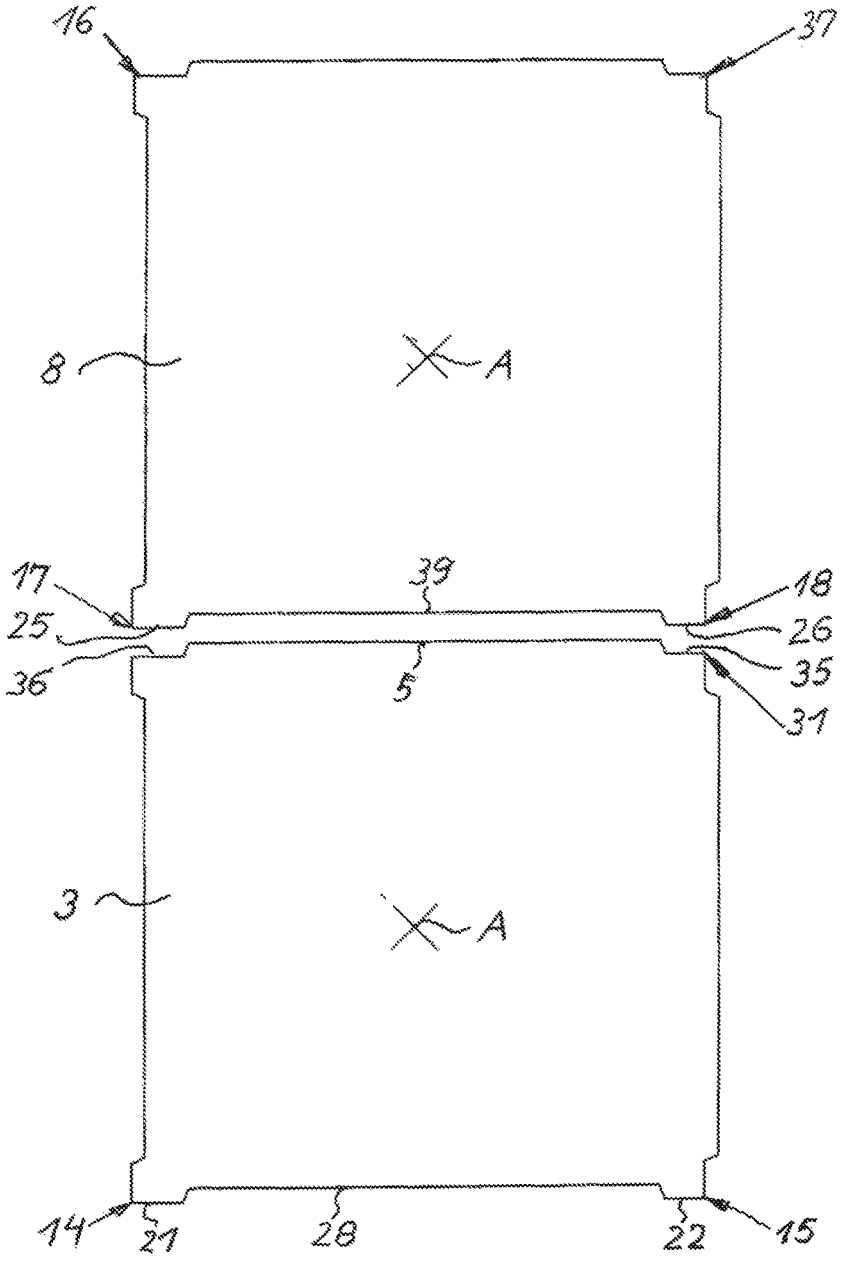
FIG. 4 shows a side view of the first vertical side panel of the top piece of furniture and the first vertical side panel of the bottom piece of furniture of the pieces of furniture with the basic shape according to FIG. 3 and nearly assembled.

In the position of the bottom piece of furniture 1 and the top piece of furniture 2 depicted in FIG. 3, the first bottom vertical side panel and the first top vertical side panel assume the position depicted in FIG. 4 in which they are rotated 90° clockwise about a horizontal axis which, in FIG. 4, runs perpendicular to the plane of the drawing and is indicated with point A.

Accordingly, in this position of the first bottom vertical side panel 3 and the first top vertical side panel 8, the projections 25, 26 of the latter on the edge 39 engage in the recesses 35, 36 in the edge 30 of the bottom vertical side panel 3 to exert their fitting function.

The projections 21, 22 in the position depicted in FIG. 4 of the first bottom vertical side panel contrastingly serve as feet for the assembled piece of furniture consisting of the bottom piece of furniture 1 and the top piece of furniture 2 that are each in the basic shape according to FIG. 3.

The connections between the first piece of furniture and the second piece of furniture in the basic shape can be easily separated in order to provide a differently assembled piece of furniture for a desired purpose.

LIST OF REFERENCE NUMBERS

1 bottom piece of furniture
2 top piece of furniture
3 first bottom vertical side panel
4 second bottom vertical side panel
5 edge
6 third panel
7 intermediate panel
8 first top vertical side panel
9 second top vertical side panel
10 edge
11 third top panel
12 top intermediate panel
13 corner region
14 corner region
15 corner region
16 corner region
17 corner region
18 corner region
19 projection
20 projection
21 projection
22 projection
23 projection
24 projection
25 projection
26 projection
27 edge
28 edge

29 edge
31 corner region
32 corner region
33 recess
34 recess
35 recess
36 recess
37 corner region
38 edge
39 edge
40 edge
42 recess
43 recess
44 recess
45 recess 4
6-59 dowel
A-A horizontal axis

The invention claimed is:

1. A multipurpose piece of furniture, wherein the piece of furniture has four substantially square panels which comprise:

a first vertical side panel, a second vertical side panel arranged at a distance from the first vertical side panel and parallel to the first vertical side panel, a third panel that is arranged between an edge of the first vertical side panel and an edge of the second vertical side panel and at a right angle to the first vertical side panel and the second vertical side panel, and that connects the first vertical side panel and the second vertical side panel into a substantially U-shaped piece of furniture, and an intermediate panel that is securely inserted into the substantially U-shaped piece of furniture between the first vertical side panel and the second vertical side panel and at a right angle to the first vertical side panel, the second vertical side panel and the third panel, characterized in that recesses and/or projections are formed at corner regions of the first vertical side panel and the second vertical side panel, the recesses and/or projections are recessed into or project out of edges of the first and second vertical side panels in a direction of extension of an edge from which the recesses and/or projections are recessed or project, and substantially in a shape of an elongated rectangle, and run at right angles to each other in directions of extension in the corner regions, wherein each edge of a first pair of two edges that run at a right angle to each other of the first vertical side panel is enclosed between two projections, and wherein each edge of a second pair of two edges that run at a right angle to each other of the first vertical side panel is bordered by two recesses.

2. The piece of furniture according to claim 1, characterized in that the first vertical side panel and the second vertical side panel have a same shape.

3. The piece of furniture according to claim 1, characterized in that the intermediate panel divides an interior of the U-shaped piece of furniture delimited by the first and second vertical side panels and the third panel into two halves of equal size.

4. The piece of furniture according to claim 2, characterized in that two projections extend a same distance out of two edges of the first and second vertical side panels running at a right angle to each other.

5. The piece of furniture according to claim 1, characterized in that the piece of furniture is substantially cuboidal with edges of equal edge length.

6. The piece of furniture according to claim 5, characterized in that the edge length is 50 cm.

7. The piece of furniture according to claim 5, characterized in that the edge length is 38 cm.

8. The piece of furniture according to claim 1, characterized in that the intermediate panel is in a horizontal position and the third panel is in a vertical position.

9. The piece of furniture according to claim 1, characterized in that the intermediate panel is in a vertical position and the third panel is in a horizontal position.

10. The piece of furniture according to claim 1, characterized in that the first and second vertical side panels are connected to the intermediate panel and the third panel by dowels, and the intermediate panel is connected to the third panel by dowels.

11. An assembled piece of furniture consisting of at least two pieces of furniture according to claim 1, characterized in that the two pieces of furniture are assembled superimposed such that projections on bottom edges of a top piece of furniture engage in recesses in bottom edges of a bottom piece of furniture or conversely, projections on top edges of the bottom piece of furniture engage in recesses in bottom edges of the top piece of furniture.

* * * * *